US007387094B2

(12) United States Patent
Asano et al.

(10) Patent No.: US 7,387,094 B2
(45) Date of Patent: Jun. 17, 2008

(54) ELECTROMAGNETICALLY DRIVEN VALVE

(75) Inventors: Masahiko Asano, Toyota (JP); Yutaka Sugie, Nishikamo-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/492,934

(22) Filed: Jul. 26, 2006

(65) Prior Publication Data

US 2007/0028872 A1 Feb. 8, 2007

(30) Foreign Application Priority Data

Aug. 8, 2005 (JP) ..... 2005-229604

(51) Int. Cl.
*F01L 9/04* (2006.01)

(52) U.S. Cl. ..... 123/90.11; 123/90.15; 251/129.01

(58) Field of Classification Search ..... 123/90.11, 123/90.15, 90.4; 251/129.01, 129.15, 129.16
See application file for complete search history.

(56) References Cited

U.S. PATENT DOCUMENTS

| | | | | |
|---|---|---|---|---|
| 4,924,821 | A | 5/1990 | Teerman | |
| 5,562,263 | A * | 10/1996 | Wagner | 244/118.5 |
| 6,089,197 | A | 7/2000 | Lange et al. | |
| 6,427,650 | B1 | 8/2002 | Cristini et al. | |
| 6,467,441 | B2 | 10/2002 | Cristiani et al. | |
| 6,710,487 | B2 * | 3/2004 | Brown | 310/90 |
| 6,718,918 | B2 | 4/2004 | Meintschel et al. | |
| 2001/0042532 | A1 | 11/2001 | Aichinger et al. | |
| 2001/0054401 | A1 | 12/2001 | Cristiani et al. | |
| 2002/0020372 | A1 | 2/2002 | Stolk et al. | |
| 2002/0057154 | A1 | 5/2002 | Keck | |
| 2003/0066500 | A1 * | 4/2003 | Kather | 123/90.11 |
| 2004/0011310 | A1 | 1/2004 | Sugimoto et al. | |
| 2004/0108482 | A1 | 6/2004 | Sakuragi et al. | |
| 2004/0201943 | A1 * | 10/2004 | Takeuchi et al. | 361/139 |

FOREIGN PATENT DOCUMENTS

| | | |
|---|---|---|
| DE | 100 00 045 A1 | 7/2001 |
| DE | 100 20 896 A 1 | 10/2001 |
| DE | 100 25 491 A 1 | 12/2001 |
| DE | 101 26 025 A1 | 1/2002 |

(Continued)

OTHER PUBLICATIONS

Extended European Search Reports dated Nov. 24, 2006 and Dec. 11, 2006.

(Continued)

*Primary Examiner*—Zelalem Eshete
(74) *Attorney, Agent, or Firm*—Kenyon & Kenyon LLP

(57) ABSTRACT

An electromagnetically driven valve that is driven by the combined action of electromagnetic force and elastic force includes first and second valve elements that have valve shafts and move in reciprocating motions in the directions in which the valve shafts extend. It also includes first and second oscillating members that extend from driving ends to pivoting ends, and that pivot around respective central axes extending at the respective pivoting ends. The driving ends are operatively linked with the first and second valve elements, respectively. The electromagnetically driven valve also includes first and second coils that cause the first and second oscillating members to oscillate. The first and second coils are interconnected.

13 Claims, 10 Drawing Sheets

FOREIGN PATENT DOCUMENTS

| | | | |
|---|---|---|---|
| DE | 100 53 596 | A1 | 5/2002 |
| DE | 102 23 673 | A1 | 12/2003 |
| DE | 102 26 010 | A1 | 12/2003 |
| EP | 1 036 964 | A1 | 9/2000 |
| EP | 1 087 110 | A1 | 3/2001 |
| EP | 1 091 368 | A1 | 4/2001 |
| EP | 1152129 | A1 | 11/2001 |
| EP | 1 331 369 | A1 | 7/2003 |
| EP | 1 403 471 | A2 | 3/2004 |
| FR | 2 812 026 | | 1/2002 |
| JP | A 2000-248968 | | 9/2000 |
| WO | WO 2006/018931 | A1 | 2/2006 |

OTHER PUBLICATIONS

Chinese Language Version of Chinese Office Action, Appln. No. 200610107567.4 dated Oct. 12, 2007.

English Translation of Chinese Office Action, Appln. No. 200610107567.4 dated Oct. 12, 2007.

* cited by examiner

ELECTROMAGNETICALLY DRIVEN VALVE

INCORPORATION BY REFERENCE

The disclosure of Japanese Patent Application No. 2005-229604 filed on Aug. 8, 2005 including the specification, drawings and abstract is incorporated herein by reference in its entirety.

BACKGROUND OF THE INVENTION

1. Field of the Invention

The invention relates generally to electromagnetically driven valves. More particularly, the invention relates to pivot-type electromagnetically driven valves that are used in internal combustion engines and are driven by electromagnetic force and elastic force.

2. Description of the Related Art

Electromagnetically driven valves have been disclosed, for example, in U.S. Pat. No. 6,467,441.

In U.S. Pat. No. 6,467,441, a pivot-type electromagnetically driven valve having a fulcrum on a disc (armature) is disclosed. When two conventional flap type electromagnetically driven valves are placed adjacent to one another and operated, the number of drive circuits increases, as does the cost and the space required for installation. Also, the electromagnetic interference between the adjacent electromagnetically driven valves reduces the electromagnetic force and increases the amount of electric power that is consumed. Also, if an attempt is made to operate two driven valves by means of one electromagnetically driven valve, the difference in the tappet clearance of the two driven valves gives rise to tappet noise.

SUMMARY OF THE INVENTION

In a first aspect of the invention, an electromagnetically driven valve is an electromagnetically driven valve that is driven by the combined action of electromagnetic force and elastic force. It includes first and second valve elements that have valve shafts and move in reciprocating motions in the directions in which the valve shafts extend. It also includes first and second oscillating members that extend from driving ends to pivoting ends, and that pivot around respective central axes extending at the respective pivoting ends. The driving ends are operatively linked with the first and second valve elements, respectively. The invention also includes first and second coils that cause the first and second oscillating members to oscillate. The first and second coils are interconnected.

In the electromagnetically driven valve in accordance with the first aspect, interconnecting the first and second coils makes it possible to simplify the circuit configuration, improve the installability, and reduce the cost. Reliable operation of the electromagnetically driven valve is also guaranteed, because the circuit is simplified.

In a second aspect of the invention, an electromagnetically driven valve is an electromagnetically driven valve that is driven by the combined action of electromagnetic force and elastic force. It includes first and second valve elements that have valve shafts and move in reciprocating motions in the directions in which the valve shafts extend. It also includes first and second oscillating members that extend from driving ends to pivoting ends, and that pivot around respective central axes extending at the respective pivoting ends. The driving ends are operatively linked with the first and second valve elements, respectively. The invention also includes first and second coils that cause the first and second oscillating members to oscillate and that are arranged so as to be adjacent to one another. Electric current is passed through the first and second coils in such a way that the magnetic fluxes in the first and second coils have the same orientation.

In the electromagnetically driven valve in accordance with the second aspect, passing electric current through the first and second coils in such a way that the magnetic fluxes in the first and second coils have the same orientation reduces the magnetic interference between the two adjacent coils. As a result, an electromagnetically driven valve is provided that can operate reliably.

In a third aspect of the invention, an electromagnetically driven valve is an electromagnetically driven valve that is driven by the combined action of electromagnetic force and elastic force. It includes first and second valve elements that have valve shafts and move in reciprocating motions in the directions in which the valve shafts extend. It also includes first and second oscillating members that extend from driving ends to pivoting ends, and that pivot around respective central axes extending at the respective pivoting ends. The driving ends are operatively linked with the first and second valve elements, respectively. The invention also includes first and second electromagnets that cause the first and second oscillating members to oscillate and that are arranged so as to be adjacent to one another. The first and second electromagnets have a common coil.

In the electromagnetically driven valve in accordance with the third aspect, a coil is shared by two electromagnets, so the circuit configuration can be simplified, installability can be improved, and cost can be reduced.

In a fourth aspect of the invention, an electromagnetically driven valve is an electromagnetically driven valve that is driven by the combined action of electromagnetic force and elastic force. It includes first and second valve elements that have valve shafts and move in reciprocating motions in the directions in which the valve shafts extend. It also includes first and second oscillating members that extend from driving ends to pivoting ends, and that pivot around respective central axes extending at the respective pivoting ends. The driving ends are operatively linked with the first and second valve elements, respectively. The pivoting ends of the first and second oscillating members are arranged so that they are offset in at least one of the vertical and horizontal directions.

In the electromagnetically driven valve in accordance with the fourth aspect, offsetting the first and second oscillating members in at least one of the vertical and horizontal directions allows the installability to be improved.

In a fifth aspect of the invention, an electromagnetically driven valve is an electromagnetically driven valve that is driven by the combined action of electromagnetic force and elastic force. It includes a valve element that has a valve shaft and moves in reciprocating motion in the directions in which the valve shaft extends. It also includes oscillating member that extends from driving end to pivoting end, and that pivots around a central axis extending at the pivoting end. The driving end is operatively linked with the valve element. The invention also includes a housing that holds the pivoting end of the oscillating member, as well as a bearing that is interposed between the housing and the pivoting end and has a coefficient of thermal expansion that is substantially identical to that of the housing. The housing and the bearing are made of non-magnetic material.

In the electromagnetically driven valve in accordance with the fifth aspect, the housing and the bearing have substantially identical coefficients of thermal expansion, so the rolling friction can be kept constant from low temperature to high temperature, so that reliable drive can be guaranteed. Moreover, because the housing and the bearing are made of non-magnetic material, the leakage of magnetic flux from the portion that supports rotation can be prevented.

In a sixth aspect of the invention, an electromagnetically driven valve is an electromagnetically driven valve that is driven by the combined action of electromagnetic force and elastic force. It includes first and second valve elements that have valve shafts and move in reciprocating motions in the directions in which the valve shafts extend. It also includes an oscillating member that extends from a driving end to pivoting end, and that pivots around a central axis extending at the pivoting end. The driving end is operatively linked with the first and second valve elements. The invention also includes first and second hydraulic lash adjusters that are arranged on the tops of the first and second valve elements. It also includes a coupling plate that is coupled with the first and second hydraulic lash adjusters, and interlocked with the oscillating member, and inside which an oil channel that supplies oil to the first and second hydraulic lash adjusters is provided.

In the electromagnetically driven valve in accordance with the sixth aspect, the tappet clearances for both the first and second valve elements are absorbed by the coupling plate and the first and second hydraulic lash adjusters. As a result, reliable operation is possible, and the generation of tappet noise is prevented.

In accordance with the invention, an electromagnetically driven valve is provided that is capable of reliable operation.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF THE PREFERRED EMBODIMENTS

Embodiments of the invention will be explained below with reference to the drawings. Note that in the embodiments below, identical reference symbols are used to represent identical or equivalent elements, and explanations thereof are not repeated.

Figure 1:
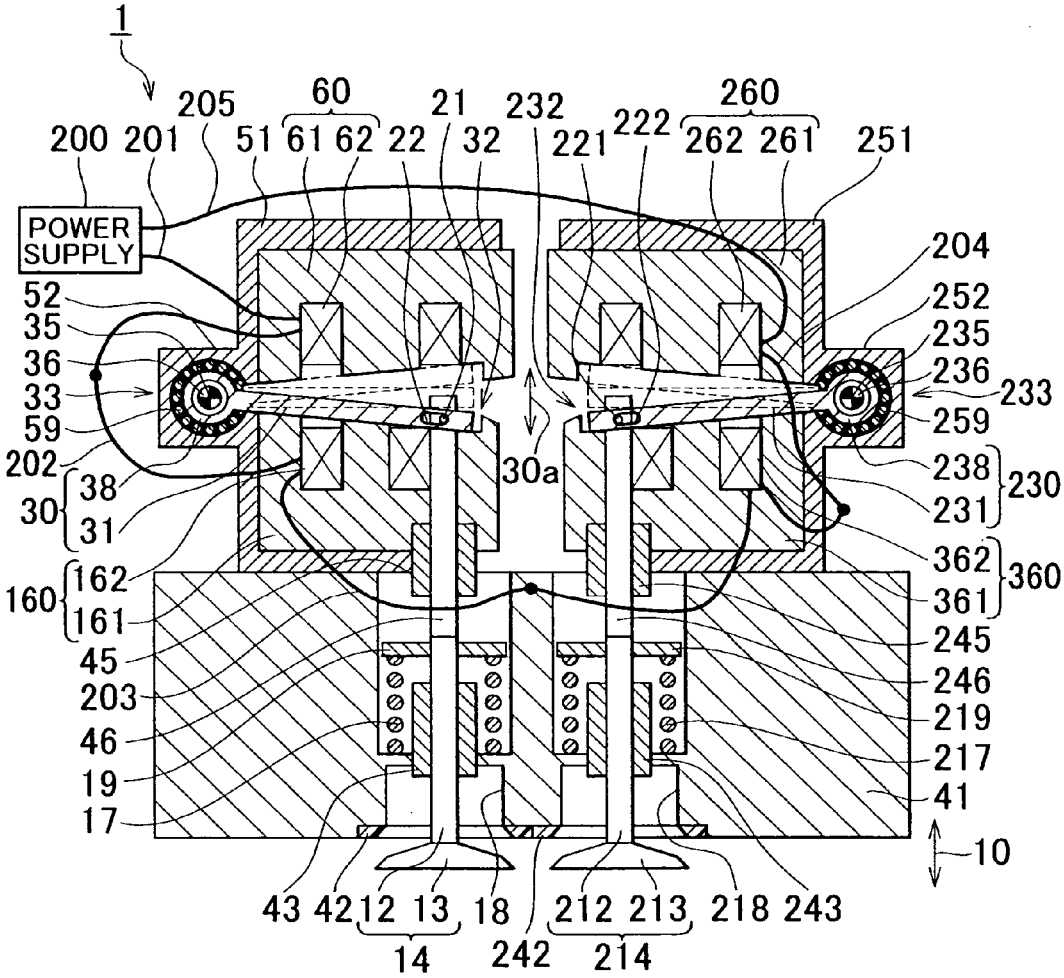
FIG. 1 is a cross-sectional view of an electromagnetically driven valve in accordance with a first embodiment of the invention.

A first embodiment of the invention will be explained below. FIG. 1 is a cross-sectional view of an electromagnetically driven valve in accordance with the first embodiment of the invention. An electromagnetically driven valve 1 in accordance with the first embodiment of the invention is an electromagnetically driven valve that is operated by the combined action of electromagnetic force and elastic force. The electromagnetically driven valve 1 includes first and second valve elements 14 and 214, a first disc 30, a second disc 230, first coils 62 and 162, and second coils 262 and 362. The first and second valve elements 14 and 214 have valve stems 12 and 212 as valve shafts, and move in reciprocating motions in the directions in which the valve stems 12 and 212 extend. The first disc 30 and the second disc 230 are first and second oscillating members that extend from driving ends 32, 232 to pivoting ends 33, 233, and that pivot around respective central axes 35, 235 extending at the respective pivoting ends 33, 233. The driving ends 32, 232 are operatively linked with the first and second valve elements 14, 214, respectively. The first coils 62 and 162 and the second coils 262 and 362 cause the first and second discs 30 and 230 to oscillate and are interconnected.

The electromagnetically driven valve 1 includes housings 51 and 251, electromagnets 60, 160, 260, and 360, which are mounted in the housings 51 and 251, the first disc 30, which is sandwiched between the electromagnets 60 and 160, the second disc 230, which is sandwiched between the electromagnets 260 and 360, and stems 46 and 246, which are driven by the first disc 30 and the second disc 230.

The housings 51 and 251 are base members in the shape of U-shape cross-section, and various elements are mounted in the housings 51 and 251. The two adjacent housings 51 and 251 are arranged so that their open sides face one another, and their protruding portions 52 and 252 are arranged so that there is some distance therebetween.

The electromagnet 60, which is mounted on the upper side and closes the valve, the electromagnet 160, which is mounted on the lower side and opens the valve, the electromagnet 260, which is mounted on the upper side and closes the valve, and the electromagnet 360, which is mounted on the lower side and opens the valve, respectively include cores 61, 161, 261, and 361, which are made of magnetic material, and coils 62, 162, 262, and 362, which are wound around the cores 61, 161, 261, and 361. Magnetic fields are generated by passing electric current through the coils 62, 162, 262, and 362, and the magnetic fields drive the first disc 30 and the second disc 230.

The first disc 30 is arranged between the electromagnets 60 and 160 and is attracted to one or the other by the attraction force of one of the electromagnets 60 and 160. In this manner, the first disc 30 moves in a reciprocating motion between the electromagnets 60 and 160. The reciprocating motion of the first disc 30 is transmitted to the stem 46.

The second disc 230 is arranged between the electromagnets 260 and 360 and is alternately attracted to one or the other by the attraction force of the electromagnets 260 and 360. In this manner, the second disc 230 moves in a reciprocating motion between the electromagnets 260 and 360. The reciprocating motion of the second disc 230 is transmitted to the stem 246.

The electromagnetically driven valve 1 in this embodiment constitutes one of an intake valve and an exhaust valve in an internal combustion engine such as a gasoline engine or a diesel engine. For this embodiment, the case where the driven valves are intake valves provided with intake ports 18 and 218 will be described, but the invention is also applicable to exhaust valves.

The electromagnetically driven valve shown in FIG. 1 is a rotating drive type of electromagnetically driven valve that uses the first disc 30 and the second disc 230 as its motion mechanisms. The housings 51 and 251 are mounted on a cylinder head 41. The coils 62, 162, 262, and 362 that configure the four electromagnets 60, 160, 260, and 360 that are contained within the housings 51 and 251 are connected in series to a power supply 200 by wires 201, 202, 203, 204, and 205. The first disc 30 includes an arm portion 31 and a bearing portion 38, and the arm portion 31 extends from the driving end 32 to the pivoting end 33. The arm portion 31 is a member that is attracted by the electromagnets 60 and 160 so that it oscillates (pivots) in the directions indicated by the arrow 30*a*. The bearing portion 38 is mounted on one end of the arm portion 31, and the arm portion 31 pivots with the bearing portion 38 as the center of pivot. The upper surface of the arm portion 31 faces the electromagnet 60, and the lower surface of the arm portion 31 faces the electromagnet 160. The arm portion 31 is provided with an oblong hole 22, and a pin 21 on the stem 46 is fitted into the oblong hole 22.

The second disc 230 includes an arm portion 231 and a bearing portion 238, and the arm portion 231 extends from the driving end 232 to the pivoting end 233. The arm portion 231 is a member that is attracted by the electromagnets 260 and 360 so that it oscillates (pivots) in the directions indicated by the arrow 30*a*. The bearing portion 238 is mounted on one end of the arm portion 231, and the arm portion 231 pivots with the bearing portion 238 as the center of pivot. The upper surface of the arm portion 231 faces the electromagnet 260, and the lower surface of the arm portion 231 faces the electromagnet 360. The arm portion 231 is provided with an oblong hole 222, and a pin 221 on the stem 246 is fitted into the oblong hole 222.

The bearing portion 38 is cylindrical, and a torsion bar 36 is housed in its interior. One end of the torsion bar 36 is fitted into the housing 51, which is the main body, by means of a spline fitting, and the other end is fitted into the bearing portion 38. As a result of this arrangement, when an attempt is made to pivot the bearing portion 38, a force in the opposite direction to the pivot is transmitted from the torsion bar 36 to the bearing portion 38. Thus an urging force is constantly applied to the bearing portion 38 in a neutral direction. The stem 46 is mounted so that it is in contact with the disc 30 at the driving end 32, and the stem 46 is guided by a stem guide 45. The stem 46 and the first disc 30 are able to move in an oscillating manner in the directions indicated by the arrow 30*a*.

The bearing portion 238 is cylindrical, and a torsion bar 236 is housed in its interior. One end of the torsion bar 236 is fitted into the housing 251, which is the main body, by means of a spline fitting, and the other end is fitted into the bearing portion 238. As a result of this arrangement, when an attempt is made to pivot the bearing portion 238, a force in the opposite direction to the pivot is transmitted from the torsion bar 236 to the bearing portion 238. Thus an urging force is constantly applied to the bearing portion 238 in a neutral direction. The stem 246 is mounted so that it is in contact with the second disc 230 at the driving end 232, and the stem 246 is guided by a stem guide 245. The stem 246 and the second disc 230 are able to move in an oscillating manner in the directions indicated by the arrow 30*a*.

The housings 51 and 251 are mounted on the cylinder head 41 so that they face one another. The intake ports 18 and 218 are provided on the bottom of the cylinder head 41. The intake ports 18 and 218 are passages for the introduction of intake air into the combustion chamber, and either the air-fuel mixture or air passes through the intake ports 18 and 218. Valve seats 42 and 242 are provided between the combustion chamber and the intake ports 18 and 218. The valve seats 42 and 242 make it possible to improve the sealability of the first valve element 14 and the second valve element 214.

The first valve element 14 and the second valve element 214 are mounted as intake valves on the cylinder head 41. The first valve element 14 and the second valve element 214 include the longitudinally extended valve stems 12 and 212 and bell portions 13 and 213, which are mounted on the ends of the valve stems 12 and 212. The valve stems 12 and 212 are guided by stem guides 43 and 243. The upper ends of the valve stems 12 and 212 are fitted with spring retainers 19 and 219 and are driven together therewith. The spring retainers 19 and 219 are urged in the upward direction by valve springs 17 and 217.

At the pivoting ends 33 and 233 of the first disc 30 and the second disc 230, bearings 59 and 259 are arranged between the bearing portions 38 and 238 and the housings 51 and 251. The bearings 59 and 259 may be either ball bearings or needle bearings. The stems 46 and 246 are in contact with the valve stems 12 and 212.

Figure 2:
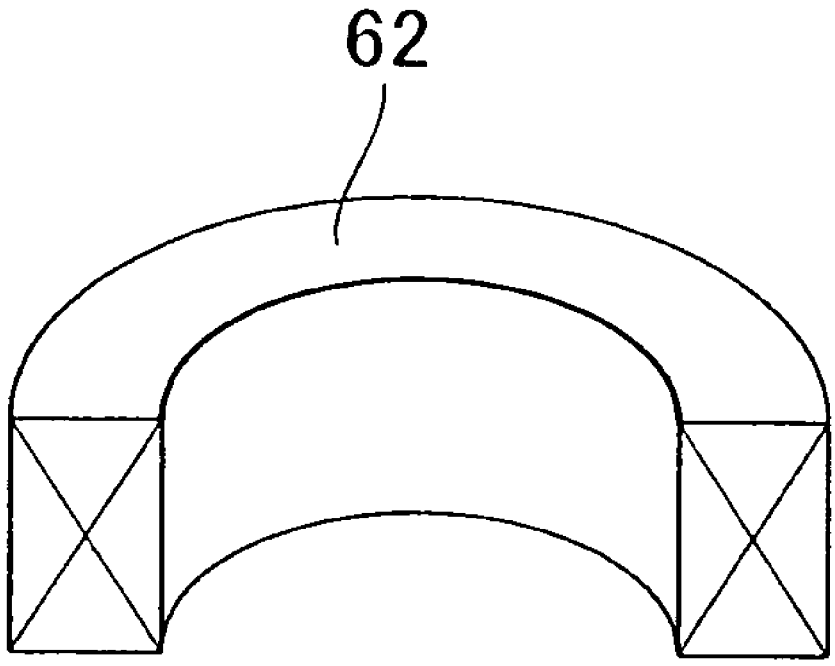
FIG. 2 is a perspective view of a coil in accordance with the invention.

FIG. 2 is a perspective view of a coil. The coil 62 is circular and is made of copper wire, for example. Magnetic flux is generated around the coil 62 in FIG. 1, making it possible for the coil 62 to attract the first disc 30, which is made of magnetic material. Magnetic flux is also generated around the coil 262, making it possible for the coil 262 to attract the second disc 230, which is made of magnetic material.

Next, the operation of an electromagnetically driven valve in accordance with the first embodiment will be explained. First, before the valve is driven, the first disc 30 is positioned between the electromagnets 60 and 160, and the second disc 230 is positioned between the electromagnets 260 and 360. These positions are determined by the torsional forces of the torsion bars 36 and 236. An electric current of a prescribed amplitude and frequency is output from the power supply 200 in such a way that the first disc 30 and the second disc 230 are attracted alternately to the electromagnets 60 and 260 on the upper side and the electromagnets 160 and 360 on the lower side. If, for example, the first disc 30 and the second disc 230 are attracted to the electromagnets 60 and 260 on the upper side, the arm portions 31 and 231 of the first and second discs 30 and 230 pivot upward, causing the torsion bars 36 and 236 to twist. The torsion bars 36 and 236 therefore try to move the arm portions 31 and 231 in the opposite direction. However, the attraction forces of the electromagnets 60 and 260 on the upper side are strong, so the arm portions 31 and 231 pivot farther upward until they finally make contact with the electromagnets 60 and 260 on the upper side. As the arm portions 31 and 231 move upward, the first valve element 14 and the second valve element 214 are pressed upward by the valve springs 17 and 217 and move upward together with the arm portions 31 and 231. In this manner, the first valve element 14 and the second valve element 214 are closed.

When the first valve element 14 and the second valve element 214 are opened, the arm portions 31 and 231 must be moved downward. At this time, the electric current that flows to the coils 62 and 262 is stopped or reduced. As a result, the electromagnetic forces of the electromagnets 60 and 260 that act on the arm portions 31 and 231 diminish. The torsional forces of the torsion bars 36 and 236 are still acting on the arm portions 31 and 231, and these torsional forces (elastic forces) overcome the electromagnetic forces to move the arm portions 31 and 231 to neutral positions. The stems 46 and 246 are pressed by the arm portions 31 and 231 so that they move downward.

Next, an electric current is output to the coils 162 and 362. As a result, magnetic fluxes are generated around the coils 162 and 362, and the arm portions 31 and 231, which are made of magnetic material, are attracted to the electromagnets 160 and 360. At this time, the stems 46 and 246 are pressed by the arm portions 31 and 231 so that they move downward. The attraction forces of the electromagnets 160 and 360 on the lower side overcome the torsional forces of the torsion bars 36 and 236, so that the arm portions 31 and 231 finally make contact with the electromagnets 160 and 360 on the lower side. At this time, the first valve element 14 and the second valve element 214 are moved downward so that they open.

Through the repetition of these upward movements and downward movements, the arm portions 31 and 231 pivot in the directions indicated by the arrow 30*a*. When the arm portions 31 and 231 pivot, their pivot is transmitted to the first valve element 14 and the second valve element 214, driving the first valve element 14 and the second valve element 214 upward and downward (the directions indicated by the arrow 10).

In the electromagnetically driven valve 1 in accordance with the first embodiment, which is configured in this manner, connecting the four coils 62, 162, 262, and 362 by the wires 201 to 205 makes it possible to simplify the circuit configuration, improve the installability, and reduce the cost. Reliability of operation is also guaranteed, because the coils 62, 162, 262, and 362 do not need to be controlled separately.

Figure 3:
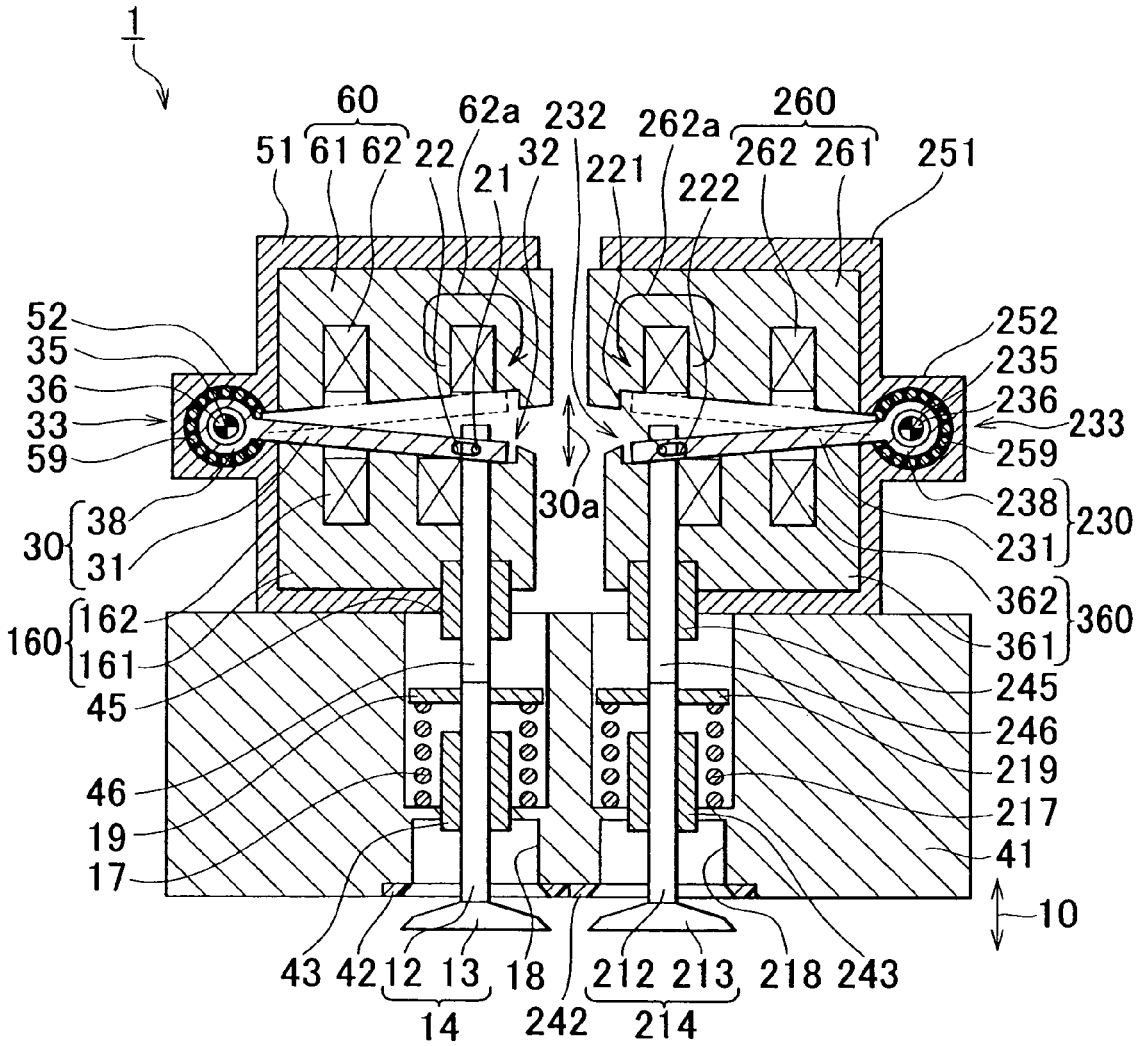
FIG. 3 is a cross-sectional view of an electromagnetically driven valve in accordance with a second embodiment of the invention.

A second embodiment of the invention will be explained below. FIG. 3 is a cross-sectional view of an electromagnetically driven valve in accordance with the second embodiment of the invention. In an electromagnetically driven valve 1 in accordance with the second embodiment of the invention, the orientation of the electric current flow in the coils is different from that in the first embodiment. Specifically, in the second embodiment, within a coil 62, the electric current on the side that is adjacent to a coil 262 flows from the front side of the paper toward the back side. As a result, magnetic flux is generated in the direction shown by arrow 62*a*. In contrast, in the coil 262, the electric current on the side that is adjacent to the coil 62 flows from the back side of the paper toward the front side. As a result, magnetic flux is generated in the direction shown by arrow 262*a*. That is, the electromagnetically driven valve 1 accordance with the second embodiment is an electromagnetically driven valve that is operated by the combined action of electromagnetic force and elastic force. The electromagnetically driven valve 1 includes a first valve element 14, a second valve element 214, a first disc 30, a second disc 230, and the coils 62 and 262 as first and second coils. The first valve element 14 and the second valve element 214 have valve stems 12 and 212, and move in reciprocating motions in the directions in which the valve stems 12 and 212 extend (arrow 10). The first disc 30 and the second disc 230 are oscillating members that extend from driving ends 32, 232 to pivoting ends 33, 233, and that pivot around respective central axes 35, 235 extending at the respective pivoting ends 33, 233. The driving ends 32, 232 are operatively linked with the first and second valve elements 14, 214, respectively. The first and second coils 62 and 262 cause the first disc 30 and the second disc 230 to oscillate and are arranged adjacent to one another. Electric current is passed through the first and second coils 62 and 262 in such a manner that the magnetic fluxes that are generated in the coils have the same orientation (arrows 62*a*, 262*a*).

In the same way, electric current is also passed through coils 162 and 362 on the lower side in such a manner that the magnetic fluxes that are generated in the adjacent portions of the coils have the same orientation.

The coils 62, 162, 262, and 362 may be connected to a power supply in a single circuit or may be connected to a power supply in separate circuits.

In the electromagnetically driven valve 1 in accordance with the second embodiment, which is configured in this manner, magnetic fluxes are generated in the same direction between the adjacent coils 62 and 262, which reduces the magnetic interference between the adjacent coils 62 and 262. As a result, the valve can be operated reliably.

Figure 4:
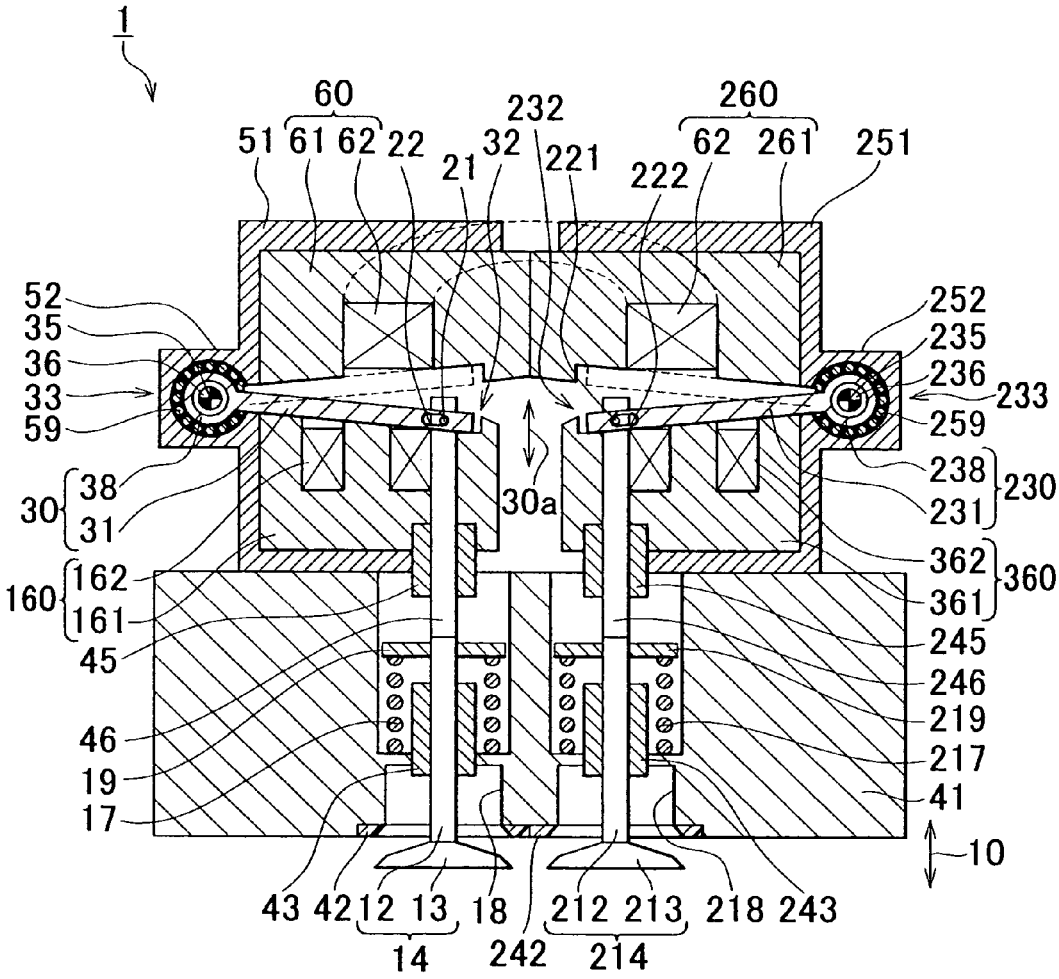
FIG. 4 is a cross-sectional view of an electromagnetically driven valve in accordance with a third embodiment of the invention.

A third embodiment of the invention will be explained below. FIG. 4 is a cross-sectional view of an electromagnetically driven valve in accordance with the third embodiment of the invention. An electromagnetically driven valve 1 in accordance with the third embodiment of the invention differs from the electromagnetically driven valve in accordance with the first embodiment in that a common coil 62 is shared by electromagnets 60 and 260 on the upper side. That is, the electromagnetically driven valve 1 in accordance with the third embodiment is an electromagnetically driven valve that is operated by the combined action of electromagnetic force and elastic force. The electromagnetically driven valve 1 includes first and second valve elements 14 and 214, first and second discs 30 and 230, and the electromagnets 60 and 260. The first and second valve elements 14 and 214 have valve stems 12 and 212 move in reciprocating motions in the directions in which the valve stems 12 and 212 extend. The first and second discs 30 and 230 are oscillating members that extend from driving ends 32, 232 to pivoting ends 33, 233, and that pivot around respective central axes 35, 235 extending at the respective pivoting ends 33, 233. The driving ends 32, 232 are operatively linked with the first and second valve elements 14, 214, respectively. The electromagnets 60 and 260 cause the first and second discs 30 and 230 to oscillate and are arranged adjacent to one another. The two electromagnets 60 and 260 share the common coil 62, which is used to close the valve. In this embodiment, the electromagnets 60 and 260 share the coil 62. However, the embodiment is not limited to this configuration, and the electromagnets 60 and 260 on the upper side that are used to close the valve may have separate coils, and the electromagnets 160 and 360 on the lower side that are used to open the valve may share a common coil.

In the electromagnetically driven valve in accordance with the third embodiment, which is configured in this manner, a coil is shared by two electromagnets, so the circuit configuration can be simplified, installability can be improved, and cost can be reduced.

Figure 5A:
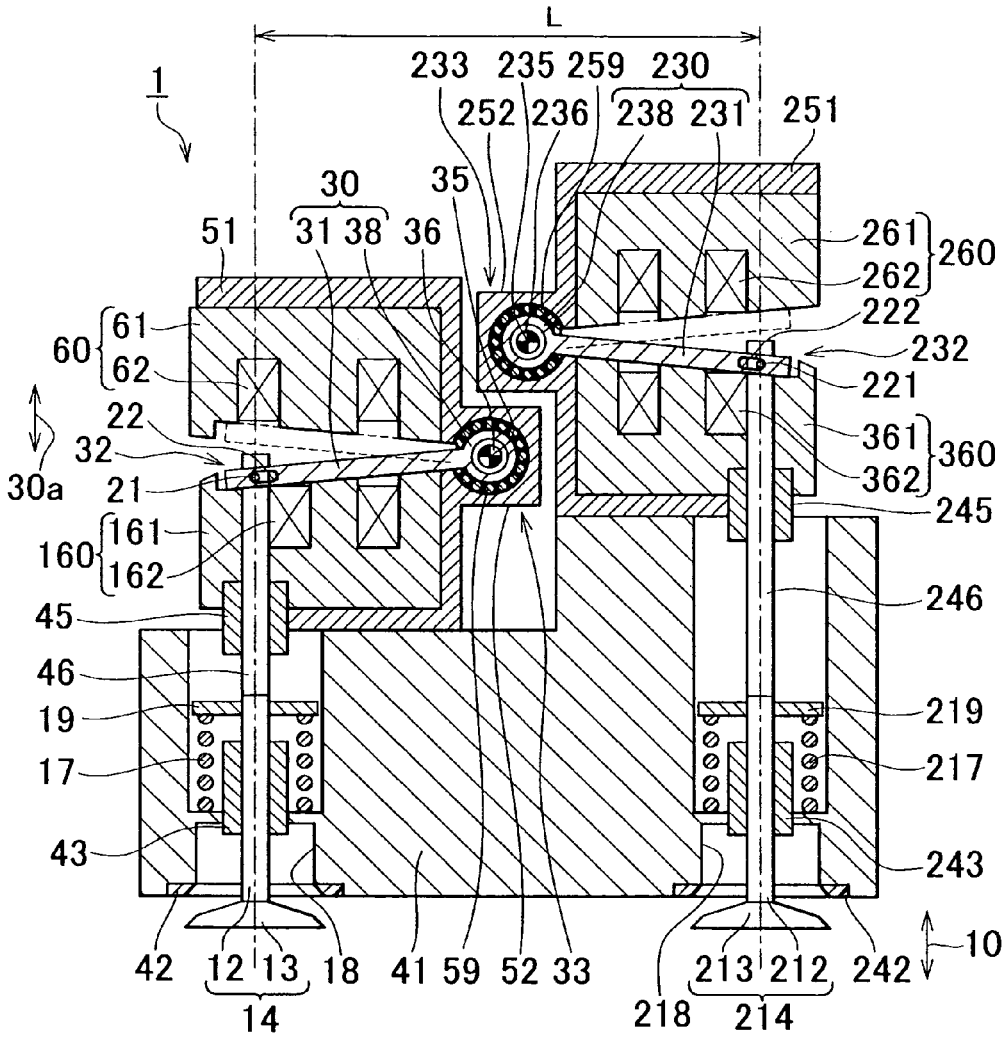
FIG. 5A is a cross-sectional view of an electromagnetically driven valve in accordance with a fourth embodiment of the invention.
Figure 5B:
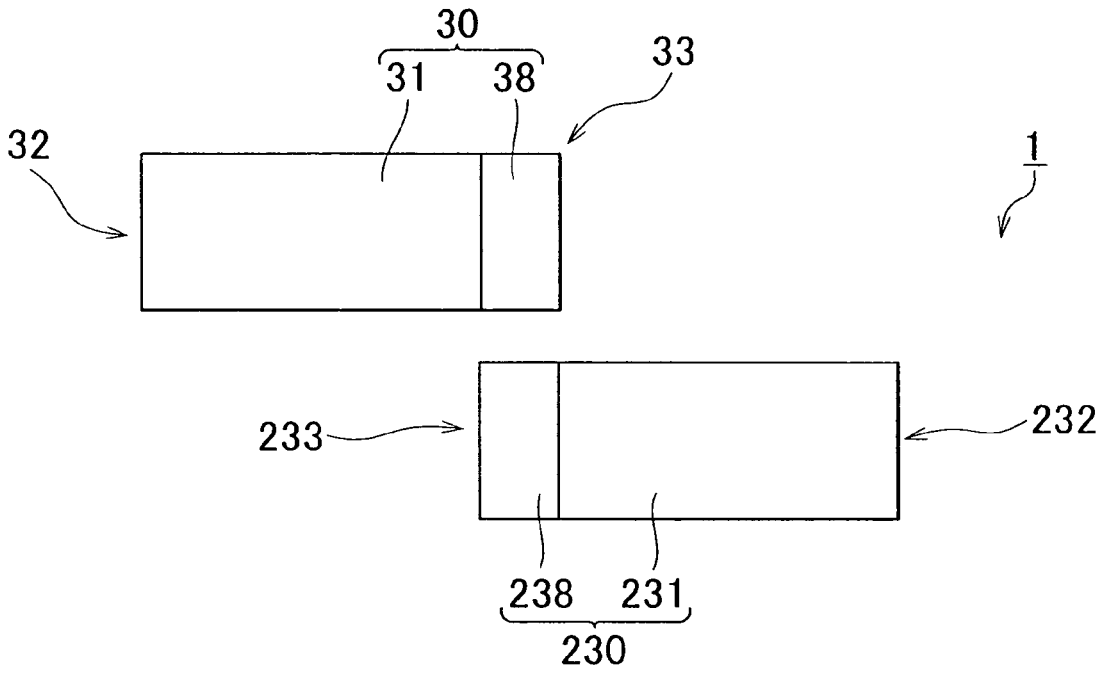
FIG. 5B is a plan view of an electromagnetically driven valve in accordance with the fourth embodiment of the invention.

A fourth embodiment of the invention will be explained below. FIG. 5A is a cross-sectional view of an electromagnetically driven valve in accordance with the fourth embodiment of the invention, and FIG. 5B is a plan view of the electromagnetically driven valve in accordance with the fourth embodiment of the invention. In an electromagnetically driven valve 1 in accordance with the fourth embodiment of the invention, as shown in FIG. 5A, differs from the electromagnetically driven valve in accordance with the first embodiment in that protruding portions 52 and 252 of housings 51 and 251 are arranged so as to be adjacent to one another and are positioned so that they are offset in the vertical direction. In FIG. 5A, pivoting ends 33 and 233 are arranged so that they are offset in the vertical direction. As shown in FIG. 5B, the pivoting ends 33 and 233 may also be arranged so that they are offset in the horizontal direction.

That is, the electromagnetically driven valve 1 in accordance with the fourth embodiment is an electromagnetically driven valve that is operated by the combined action of electromagnetic force and elastic force. The electromagnetically driven valve 1 includes first and second valve elements 14 and 214, and first and second discs 30 and 230. The first and second valve elements 14 and 214 have valve stems 12 and 212, and move in reciprocating motions in the directions in which the valve stems 12 and 212 extend (arrow 10). The first and second discs 30 and 230 are oscillating members that extend from driving ends 32, 232 to pivoting ends 33, 233, and that pivot around respective central axes 35, 235 extending at the respective pivoting ends 33, 233. The driving ends 32, 232 are operatively linked with the first and second valve elements 14, 214, respectively. The pivoting ends 33, 233 of the first and second discs 30 and 230 are arranged so that they are offset in at least one of the vertical direction and the horizontal direction. The pivoting ends 33, 233 may be arranged so that they are offset only in the vertical direction, as shown in FIG. 5A. The pivoting ends 33, 233 may also be arranged so that they are offset only in the horizontal direction, as shown in FIG. 5B. The pivoting ends 33, 233 may also be arranged so that they are offset both in the vertical direction and in the horizontal direction.

In this embodiment, because the pivoting ends 33, 233 are installed so as to be adjacent to one another, as shown in FIG. 5, the first valve element 14 and the second valve element 214 are positioned so that they are separated from one another, unlike in the first, second, and third embodiments. Here, L is the distance between the first valve element 14 and the second valve element 214.

Figure 6:
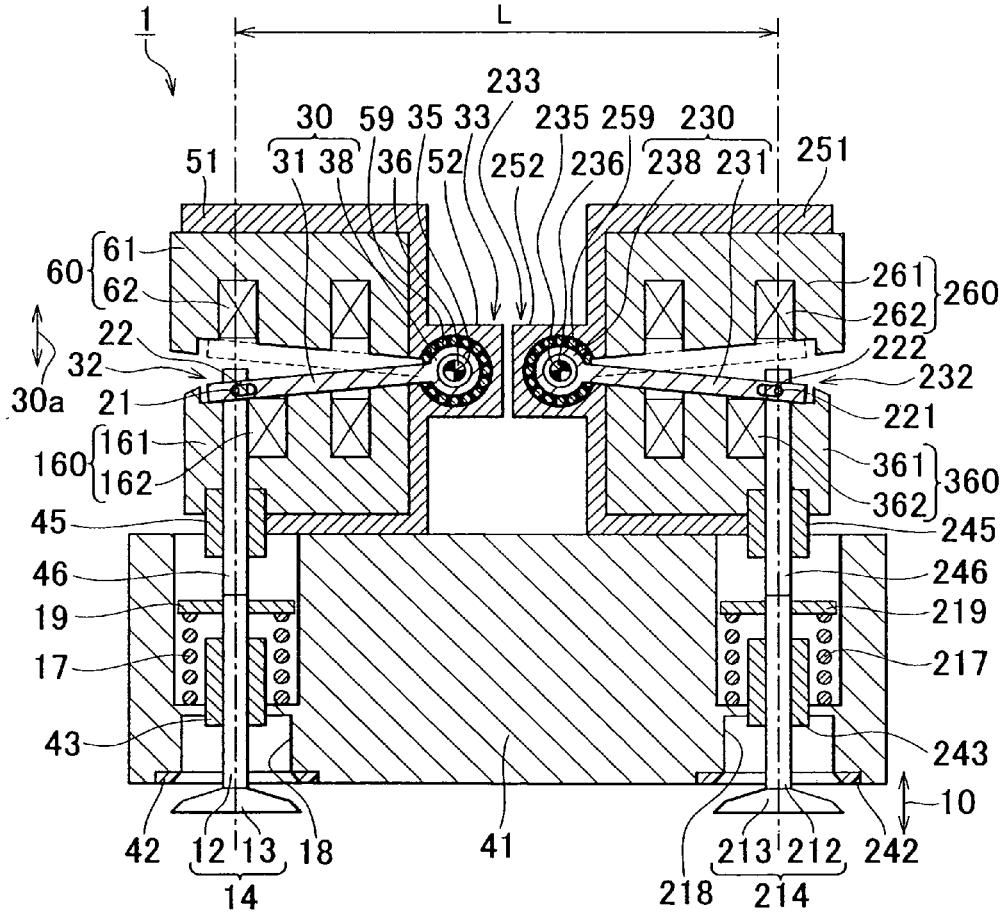
FIG. 6 is a cross-sectional view of an electromagnetically driven valve in accordance with a comparative example of the invention.

FIG. 6 is a cross-sectional view of an electromagnetically driven valve in accordance with a comparative example of the invention. When the pivoting ends 33, 233 are not arranged so that they are offset, the distance L between the first valve element 14 and the second valve element 214 is greater than that shown FIG. 5. This is because the positions of the protruding portions 52 and 252 interfere with one another.

In the electromagnetically driven valve in accordance with the fourth embodiment, which is configured in this manner, the device can be made smaller and installability can be improved.

Figure 7:
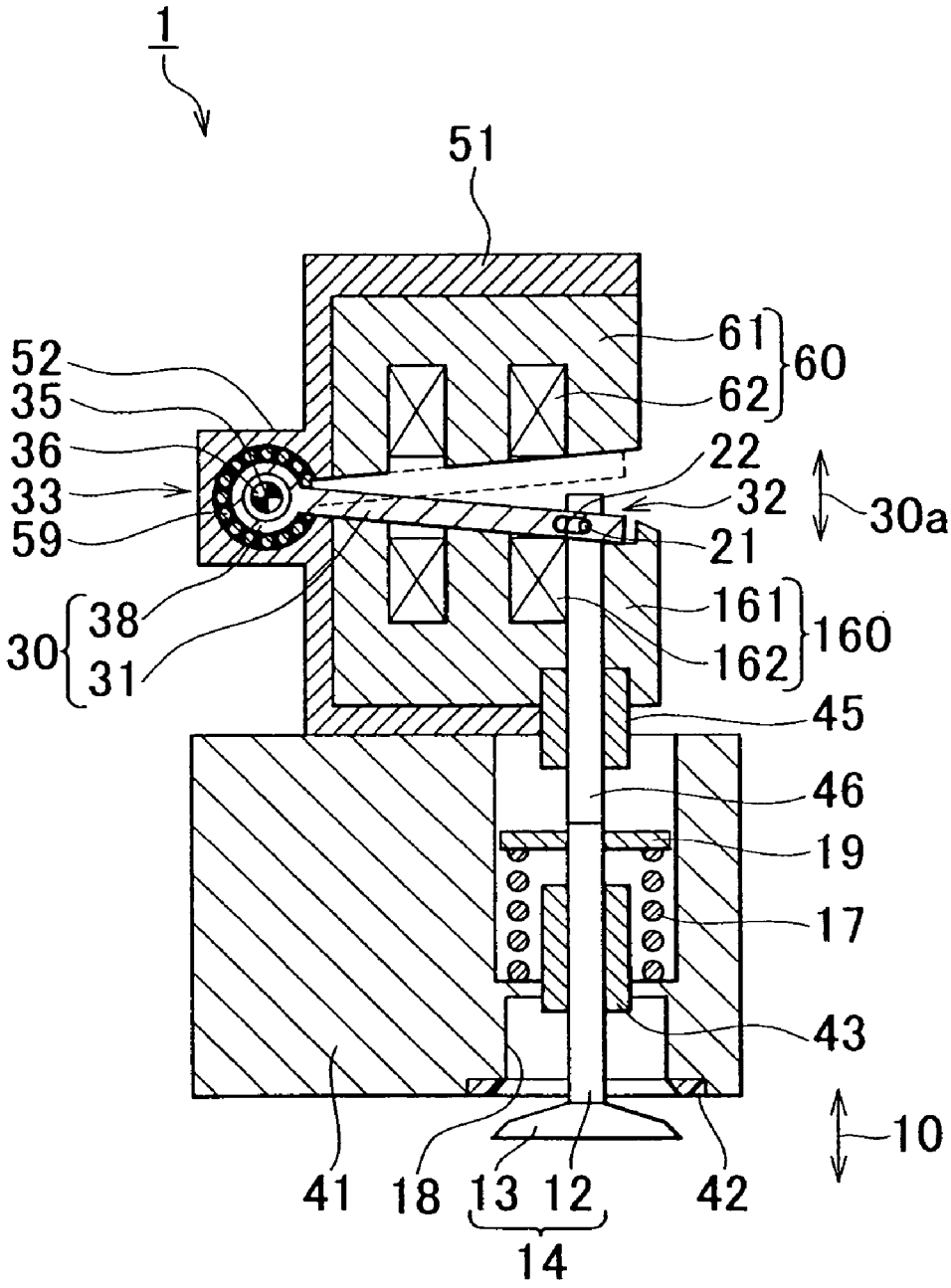
FIG. 7 is a cross-sectional view of an electromagnetically driven valve in accordance with a fifth embodiment of the invention.

A fifth embodiment of the invention will be explained below. FIG. 7 is a cross-sectional view of an electromagnetically driven valve in accordance with the fifth embodiment of the invention. In an electromagnetically driven valve 1 in accordance with the fifth embodiment of the invention, a housing 51 and a bearing 59 are made of non-magnetic materials, such as stainless steel (SUS304), for example, and the housing 51 and the bearing 59 have substantially identical coefficients of thermal expansion. That is, the electromagnetically driven valve 1 valve in accordance with the fifth embodiment is an electromagnetically driven valve that is operated by the combined action of electromagnetic force and elastic force. The electromagnetically driven valve 1 includes a first valve element 14, a first disc 30, the housing 51, and the bearing 59. The first valve element 14 has a valve stem 12, and moves in reciprocating motion in the direction in which the valve stem 12 extends. The first disc 30 is an oscillating member that extends from a driving end 32 to pivoting end 33, and that pivots around central axis 35 extending at the pivoting end. The driving end 32 is operatively linked with the valve element 14. The housing 51 holds the pivoting end 33 of the first disc 30. The bearing 59 is interposed between the housing 51 and the pivoting end 33 and has a coefficient of thermal expansion that is substantially identical to that of the housing 51. The bearing 59 and the housing 51 are made of non-magnetic materials.

The bearing 59 and the housing 51 may be made of the same non-magnetic material, or they may be made of different non-magnetic materials. Furthermore, two housings may be arranged side-by-side, as shown in the first to fourth embodiments, in which case two valve elements will be driven.

In the electromagnetically driven valve in accordance with the fifth embodiment, which is configured in this manner, the housing 51 and the bearing 59 have substantial identical coefficients of thermal expansion, so the rolling friction can be kept constant from low temperature to high temperature. Moreover, the leakage of magnetic flux from the portion of the pivoting end 33 that supports rotation can be prevented, so that reliable drive can be guaranteed.

Figure 8:
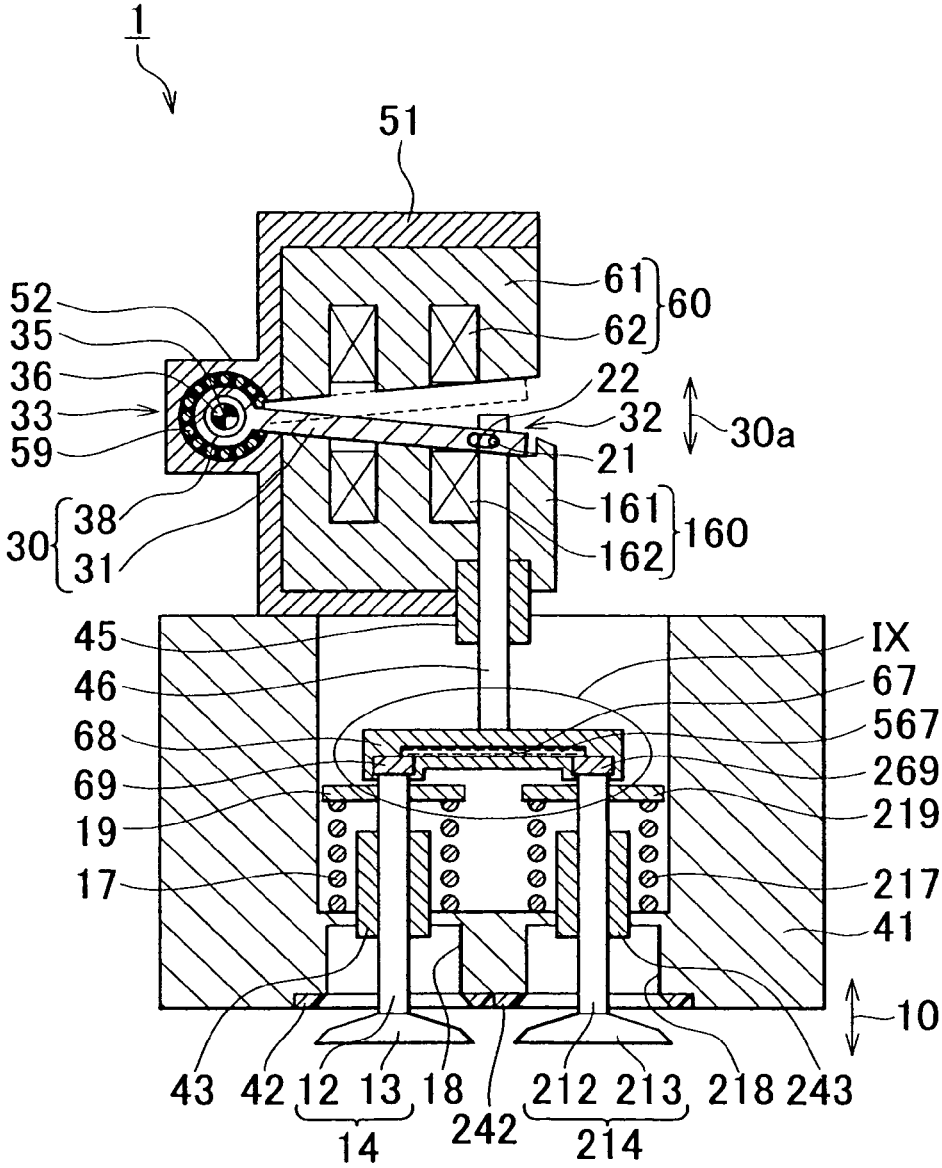
FIG. 8 is a cross-sectional view of an electromagnetically driven valve in accordance with a sixth embodiment of the invention.
Figure 9:
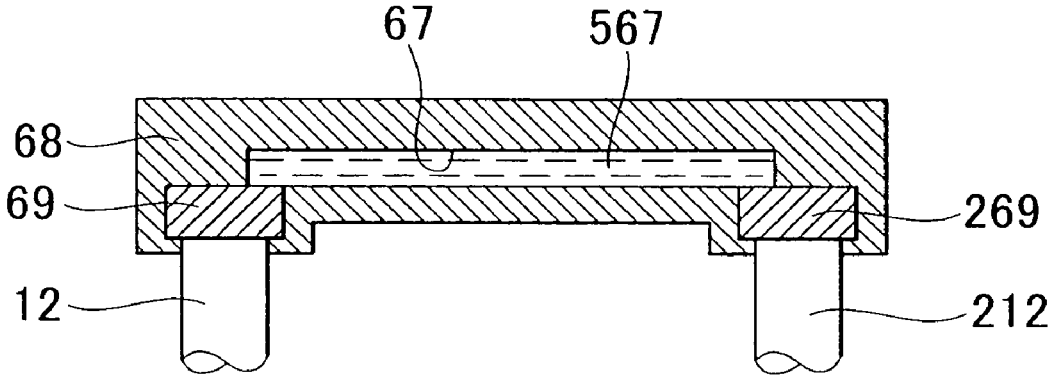
FIG. 9 is an enlarged cross-sectional view of the portion of FIG. 8 that is indicated by the circle IX.

A sixth embodiment of the invention will be explained below. FIG. 8 is a cross-sectional view of an electromagnetically driven valve in accordance with the sixth embodiment of the invention. FIG. 9 is an enlarged cross-sectional view of the portion of FIG. 8 that is indicated by the circle IX. In an electromagnetically driven valve 1 in accordance with the sixth embodiment of the invention, a coupling plate 68 is provided between a stem 46 and valve stems 12 and 212. First and second hydraulic lash adjusters 69 and 269 are arranged on the tops (ends) of the valve stems 12 and 212, and an oil channel 67 is provided in the coupling plate 68 to provide an oil 567 to the first and second hydraulic lash adjusters 69 and 269. The first and second hydraulic lash adjusters 69 and 269 are mechanisms for the purpose of filling the gaps between the coupling plate 68 and the valve stems 12 and 212. The oil for the first and second hydraulic lash adjusters 69 and 269 circulates between them through the oil channel 67.

In this embodiment, the case where a single first disc 30 drives a first valve element 14 and a second valve element 214 will be explained, but the embodiment is not limited to this configuration, and three or more valve elements may be driven by the single first disc 30.

That is, the electromagnetically driven valve 1 in accordance with the sixth embodiment is an electromagnetically driven valve that is operated by the combined action of electromagnetic force and elastic force. The electromagnetically driven valve 1 includes the first and second valve elements 14 and 214, the first disc 30, the first and second hydraulic lash adjusters 69 and 269, and the coupling plate 68. The first and second valve elements 14 and 214 have the valve stems 12 and 212, and move in reciprocating motions in the directions in which the valve stems 12 and 212 extend. The first disc 30 is an oscillating member that extends from a driving end 32 to a pivoting end 33, and that pivots around a central axis 35 extending at the pivoting end 33. The driving end 32 is operatively linked with the first and second valve elements 14, 214. The first and second hydraulic lash adjusters 69 and 269 are provided at the tops of the first and second valve elements 14 and 214. The coupling plate 68 is coupled with the first and second hydraulic lash adjusters 69 and 269, and interlocked with the first disc 30, and inside which the oil channel 67 that supplies the oil 567 to the first and second hydraulic lash adjusters 69 and 269 is provided. In the electromagnetically driven valve in accordance with the sixth embodiment, which is configured in this manner, the tappet clearances for both the first and second valve elements 14 and 214 are absorbed by the coupling plate 68 and the first and second hydraulic lash adjusters 69 and 269, so the generation of tappet noise is prevented.

Embodiments of the invention have been explained above, but numerous variations of the embodiments shown here are possible. For example, the invention may be structured so that electromagnets are arranged between two parallel discs.

The embodiments disclosed herein are illustrative examples in every respect and should be considered to be non-limiting. The scope of the invention is indicated not by the explanations above, but by the scope of the claims, and it is intended that the equivalents of the claims and all modifications within the spirit and scope of the claims be included.

The invention can be used, for example, in the field of electromagnetically valve elements for internal combustion engines that are mounted in vehicles.

What is claimed is:

1. An electromagnetically driven valve that is operated by the combined action of electromagnetic force and elastic force, comprising:

first and second valve elements that have valve shafts and move in reciprocating motions in directions in which the valve shafts extend;

first and second oscillating members that extend from driving ends to pivoting ends, and that pivot around respective central axes extending at the respective pivoting ends, wherein the driving ends are operatively linked with the first and second valve elements, respectively; and first and second coils that cause the first and second oscillating members to oscillate and that are arranged so as to be adjacent to one another, wherein electric current is passed through the first and second coils to open first and second valves, respectively, such that magnetic fluxes in the first and second coils have the same orientation.

2. The electromagnetically driven valve according to claim 1 wherein the first and second coils are interconnected.

3. The electromagnetically driven valve according to claim 1, wherein the first and second coils are connected in series to a power supply by wire.

4. The electromagnetically driven valve according to claim 1, wherein the first and second coils are connected in a single circuit.

5. The electromagnetically driven valve according to claim 1, wherein the first and second coils are connected in separate circuits.

6. An electromagnetically driven valve that is operated by the combined action of electromagnetic force and elastic force, comprising:

first and second valve elements that have valve shafts and move in reciprocating motions in directions in which the valve shafts extend;

first and second oscillating members that extend from driving ends to pivoting ends, and that pivot around respective central axes extending at the respective pivoting ends, wherein the driving ends are operatively linked with the first and second valve elements, respectively; and first and second electromagnets that cause the first and second oscillating members to oscillate and that are arranged so as to be adjacent to one another, wherein the first and second electromagnets have a common continuously wound coil.

7. The electromagnetically driven valve according to claim 6, wherein the common coil is a coil for opening the first and second valve elements.

8. The electromagnetically driven valve according to claim 6, wherein the common coil is a coil for closing the first and second valve elements.

9. The electromagnetically driven valve according to claim 6 further comprising first and second housings that hold the pivoting ends of the oscillating members; and first and second bearings that are interposed between the housings and the pivoting ends, and the bearings having coefficients of thermal expansion that are substantially identical to that of the housings, wherein the housings and the bearings are made of non-magnetic material.

10. The electromagnetically driven valve according to claim 9, wherein the non-magnetic material is stainless steel.

11. The electromagnetically driven valve according to claim 9, wherein the housing and the bearing are made of the same non-magnetic material.

12. The electromagnetically driven valve according to claim 6 further comprising first and second hydraulic lash adjusters that are arranged on tops of the first and second valve elements; and a coupling plate that is coupled with the first and second hydraulic lash adjusters.

13. An electromagnetically driven valve that is operated by the combined action of electromagnetic force and elastic force, comprising:

first and second valve elements that have valve shafts and move in reciprocating motions in directions in which the valve shafts extend; and first and second oscillating members that extend from driving ends to pivoting ends, and that pivot around respective central axes extending at the respective pivoting ends, wherein the driving ends are operatively linked with the first and second valve elements, respectively, wherein the pivoting ends of the first and second oscillating members are arranged so that they are spaced from one another in vertical and horizontal directions and at least a portion of the second pivoting end is located above at least a portion of the first pivoting end.

* * * * *

UNITED STATES PATENT AND TRADEMARK OFFICE

CERTIFICATE OF CORRECTION

PATENT NO. : 7,387,094 B2
APPLICATION NO. : 11/492934
DATED : June 17, 2008
INVENTOR(S) : Masahiko Asano et al.

It is certified that error appears in the above-identified patent and that said Letters Patent is hereby corrected as shown below:

| Column | Line | |
|---|---|---|
| 3 | 20 | After “inside” change “which” to --where--. |
| 9 | 1 | Change “In an” to --The--. |
| 12 | 56 | Change “arranged” to --offset--. |

Signed and Sealed this

Ninth Day of June, 2009

John Doll

JOHN DOLL
*Acting Director of the United States Patent and Trademark Office*